US007037131B1

(12) United States Patent
Chen et al.

(10) Patent No.: US 7,037,131 B1
(45) Date of Patent: May 2, 2006

(54) ADJUSTABLE LOCKING DEVICE

(75) Inventors: Chang-Nan Chen, Shinjuang (TW); Teng-Sheng Hung, Shinjuang (TW); Jui-Chih Hung, Shinjuang (TW)

(73) Assignee: Liang Tai Co., Ltd., Taipei (TW)

( * ) Notice: Subject to any disclaimer, the term of this patent is extended or adjusted under 35 U.S.C. 154(b) by 0 days.

(21) Appl. No.: 11/014,654

(22) Filed: Dec. 17, 2004

(51) Int. Cl.
*H01R 13/62* (2006.01)
*H01R 13/64* (2006.01)

(52) U.S. Cl. ..... 439/372; 439/362

(58) Field of Classification Search ..... 439/372, 439/362, 368, 358, 341, 370, 270
See application file for complete search history.

(56) References Cited

U.S. PATENT DOCUMENTS 3,479,701 A * 11/1969 Zerfoss ..... 292/66
4,031,382 A * 6/1977 Laughter ..... 362/374
5,201,670 A * 4/1993 Watanabe et al. ..... 439/372
5,474,465 A * 12/1995 Kobayashi ..... 439/278

* cited by examiner

*Primary Examiner*—Hae Moon Hyeon

(57) ABSTRACT

An adjustable locking device includes a main body, at least a link structure, and at least a buckling device. The main body includes a connection portion. The connection portion provides one end of the link structure to connect thereon. The link structure includes a link element and an adjusting element connected to the link element. The link element provides a buckling device to pivotally connect thereon. The buckling device includes an actuating element and a buckling element. The actuating element and the buckling element are mutually connected, whereby the link structure can be moved within the connection portion of the main body, so as to change the position of the buckling device. The connection tightness between the main body and the connection port is thus enhanced.

10 Claims, 10 Drawing Sheets

ADJUSTABLE LOCKING DEVICE

BACKGROUND OF THE INVENTION

The present invention relates generally to an adjustable locking device, and more particularly to an adjustable locking device that is applied to connectors for transmitting electronic signals. The locking device can enhance the connection between the connector and the connection port by adjusting the relative position of the locking device therebetween.

The development of information technology and computer industry has resulted in an overwhelming use of electrical connectors. The electrical connectors are often used to extend the range that signals or power are transmitted. However, after some plugging in and out of the connectors, the connection of which is often loosen, giving rise to an interruption of signal transmission. This is even worse for connectors used for wobbling peripheral devices, such as a printer, photocopier, or computer system on a vehicle. In order to solve this problem, a locking device is added to the connector, so as to prevent the connector from loosening away from the connection port. Therefore, to provide a connector that can securely and rapidly be fastened to the connection port is one import issue to address.

Conventional connector locking device shown in FIG. 1 includes a connector 10*a* and a connection port 20*a*. A rectangular protrusive ear 11*a* is formed at two sides of the connector 10*a*. A hole 12*a* is formed at the central portion of the protrusive ear 11*a*. Correspondingly, a screw hole 21*a* is formed at two sides of the connection port 20*a*. The screw hole 21*a* is so formed corresponding to the position of the hole 12*a*, thereby providing a screw 22*a* to penetrate therethrough and securely fastening the connector 10*a* with the connection port 20*a*. However, the employment of a screw requires more efforts in the assembling and disassembling process. This is particularly inconvenient for those connectors that require frequent plugging in and out (e.g. for performance benchmark.) In addition, the connectors described above are lack of damp proof function. The terminals of the connectors are easily oxidated due to the atmospheric humidity, thereby largely reducing the life of the connectors.

Therefore, the inventors of the present invention devoted themselves, based on their many years of practical experiences, in developing a new connector that can solve those and other problems set forth above.

BRIEF SUMMARY OF THE INVENTION

The present invention is to provide an adjustable locking device, which can move within the connection portion of the main body, so as to adjust the position of the locking device, thereby enhancing the connection tightness between the main body and the connection port.

In order to achieve the above and other objectives, the adjustable locking device of the present invention includes: a main body having a connection portion formed thereon; at least a link structure with one end thereof being connected to the connection portion of the main body, the link structure including a link element and an adjusting element connected to the link element; and at least a buckling device pivotally connected to the link element of the link structure, the buckling device including an actuating element and a buckling element, the actuating element and the buckling element being mutually connected, thereby achieving the objectives as set forth above.

DETAILED DESCRIPTION OF THE INVENTION

In order to better understanding the features and technical contents of the present invention, the present invention is hereinafter described in detail by incorporating with the accompanying drawings. However, the accompanying drawings are only for the convenience of illustration and description, no limitation is intended thereto.

Figure 1:
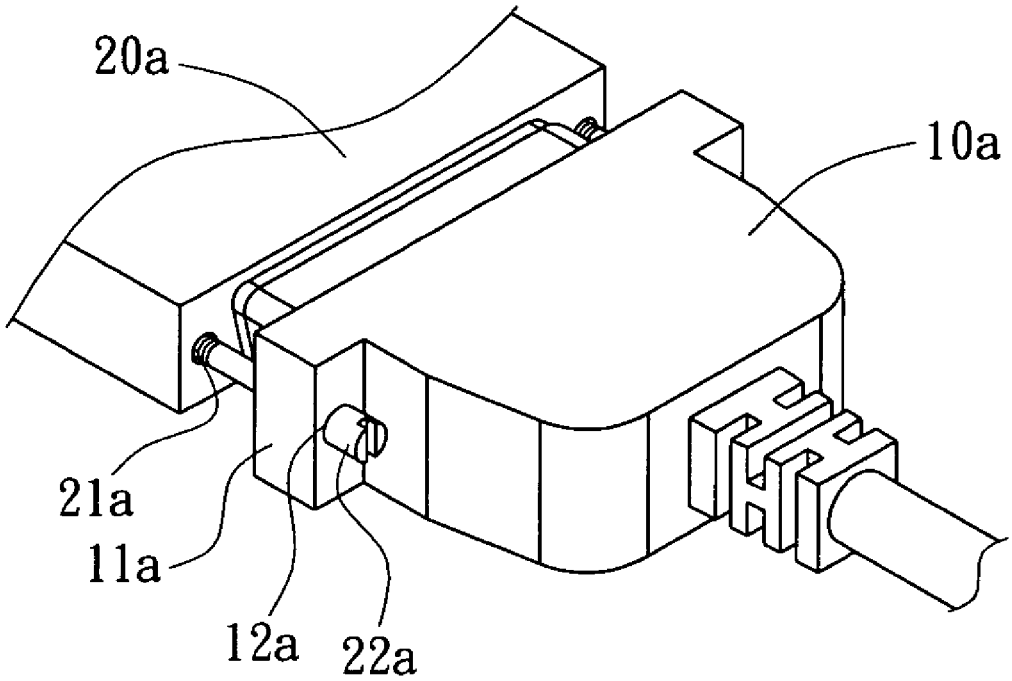
FIG. 1 PRIOR ART
FIG. 1 illustrates a conventional connector locking device.
Figure 2:
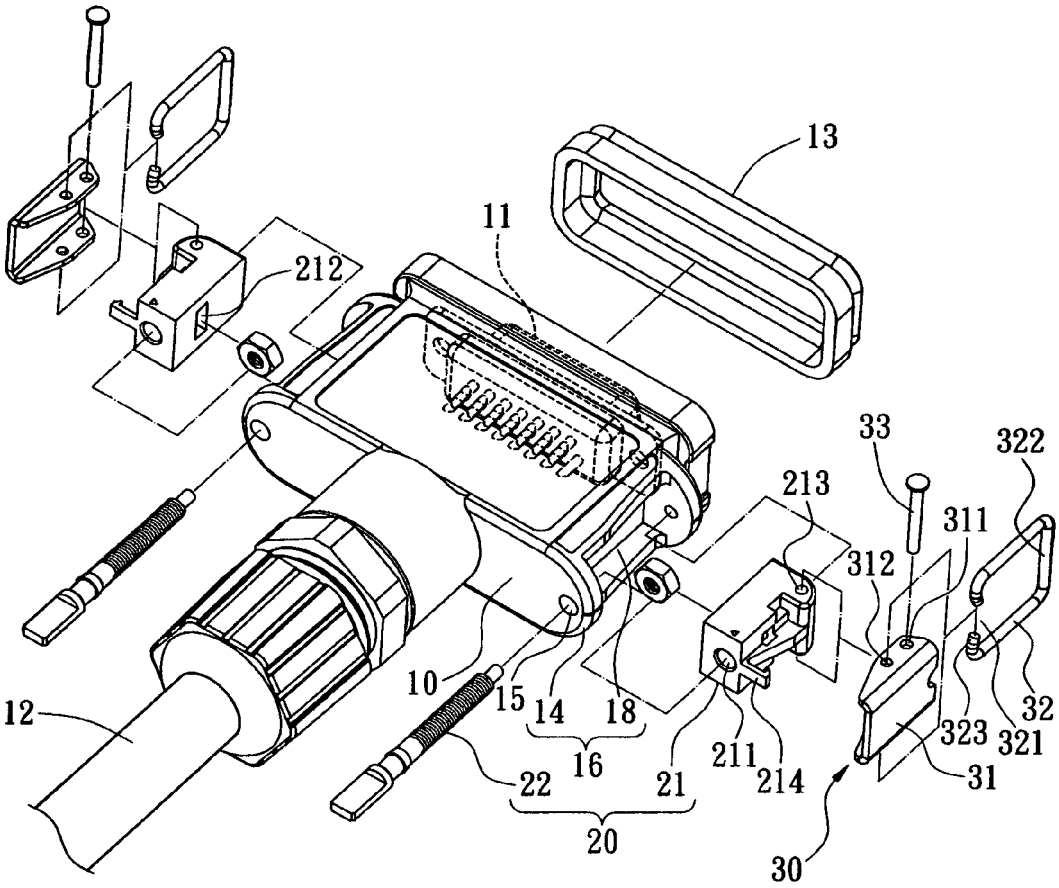
FIG. 2 is an explosive view of a locking device in accordance with the first embodiment of the present invention.
Figure 3:
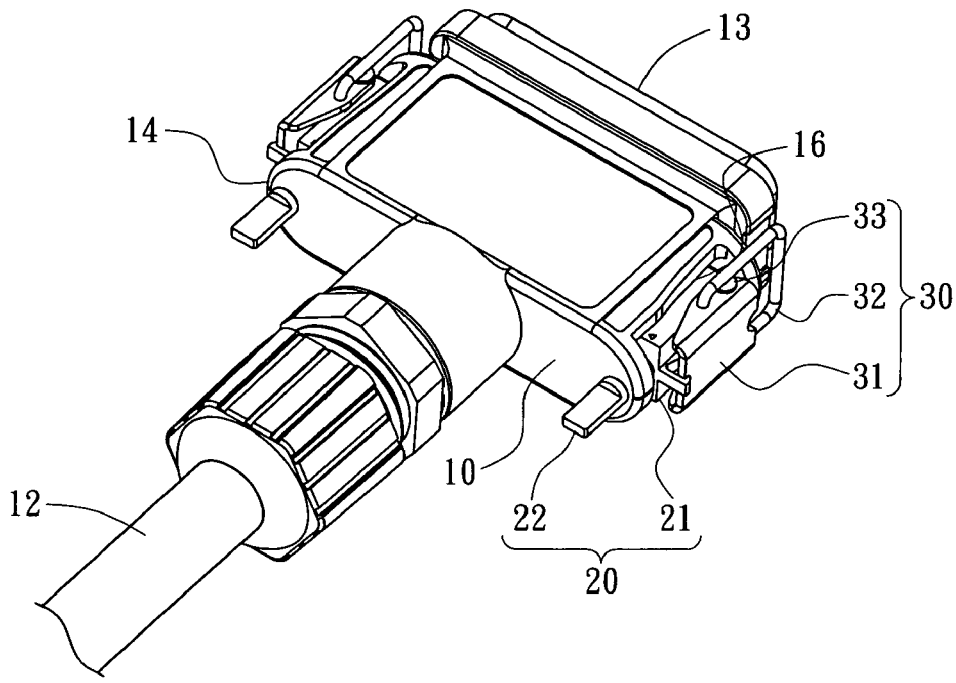
FIG. 3 is a perspective view of the locking device in accordance with the first embodiment of the present invention.

Referring to FIG. 2 and FIG. 3, an explosive view and a perspective view of an adjustable locking device in accordance with the first embodiment of the present invention are illustrated. The adjustable locking device can be applied to a connector for transmitting electronic signals or to a lock of luggage bag. In this particular embodiment, the locking device is applied to a connector. The connector includes a main body 10, at least a link structure 20 and at least an actuating device 30.

The main body 10 can be a power plug, an IEEE394 connector, a RJ-45 connector, a D-SUB connector, a RCA jack, a phone jack or an S terminal. In this particular embodiment, the main body 10 is a D-SUB connector and is in a rectangular shape, which includes a connection port 11, and a conductor portion 12. The connection port 11 is extended from the front portion of the main body 10, which includes a plurality of contact terminals disposed therein. A circular concave groove 111 (shown in FIG. 6) is formed at the outer periphery of the contact terminals. The concave grooves 111 provide a damp proof ring pad 13 to be inserted therein. A conductor portion 12 is disposed on the other end of the connection port 11 of the main body 10. In addition, two semi-circular protrusive ears 14 are formed extending from the left and right sides of the main body 10. A through hole 15 is formed on each of the protrusive ears 14. Furthermore, a sag region 18 is formed on the two protrusive ears 14 at the same side, where in this particular embodiment, the sag region 18 and the two protrusive ears 14 forming a connection portion 16 of the main body 10.

The link structure 20 can be appreciated as a single set or a double set structure being connected to the main body 10. In this particular embodiment, the link structure 20 is of a double set structure. The link structure 20 includes a link element 21 and an adjusting element 22. One end of the link element 21 can be connected to the connection portion 16 of the main body 10. A horizontally arranged penetrating hole 211 and a groove hole 212 communicable with the penetrating hole 211 are formed on the link element 21. The groove hole 212 provides a fastening element, such as a nut, to be disposed therein, while the penetrating hole 211 provides the adjusting element 22 to penetrate therethrough. In this particular embodiment, the adjusting element 22 is a screw, which penetrates through the through hole 15 of the main body 10, the penetrating hole 211 of the link element 21, the nut, and another through hole 15 of the main body 10. The link element 21 is thus fastened in the sag region 18 of the connection portion 16 mentioned above. Moreover, vertically arranged hole 213 is formed on the link element 21. A locking hook 214 is formed extending from one end of the link element 21.

The actuating device 30 can also be appreciated as a single set or a double set structure that is pivotally connected to the link element 21 described above. Should the actuating device 30 be a single set structure, the other end is then a fixed connection device (not shown). In this particular embodiment, the actuating device 30 is of a double set structure. The actuating device 30 includes a actuating element 31 and a buckling element 32. The actuating element 31 is made of a metallic plate, which is directly curved into a U shape. A first through hole 311 and a second through hole 312 are formed on the plate of opposite ends. The first through hole 311 corresponds the hole 213 of the link element 21 for penetrating therethrough a shaft 33, thereby pivotally connecting the link element 21 and the actuating element 31 together. The second through hole 312 provides the buckling element 32 to be pivotally connected. The buckling element 32 is made of a curved metallic wire, forming a rectangular frame that includes an opening end 321 and a closed end 322. It is appreciated that the buckling element 32 can also be of semi-circular, triangular, trapezoidal or other geometrical shapes. A cylindrical shaft 323 is formed on each of the upper and lower opening ends 321 of the buckling element 32. The cylindrical shaft 323 penetrates through the second through hole 312 of the actuating element.

Figure 4:
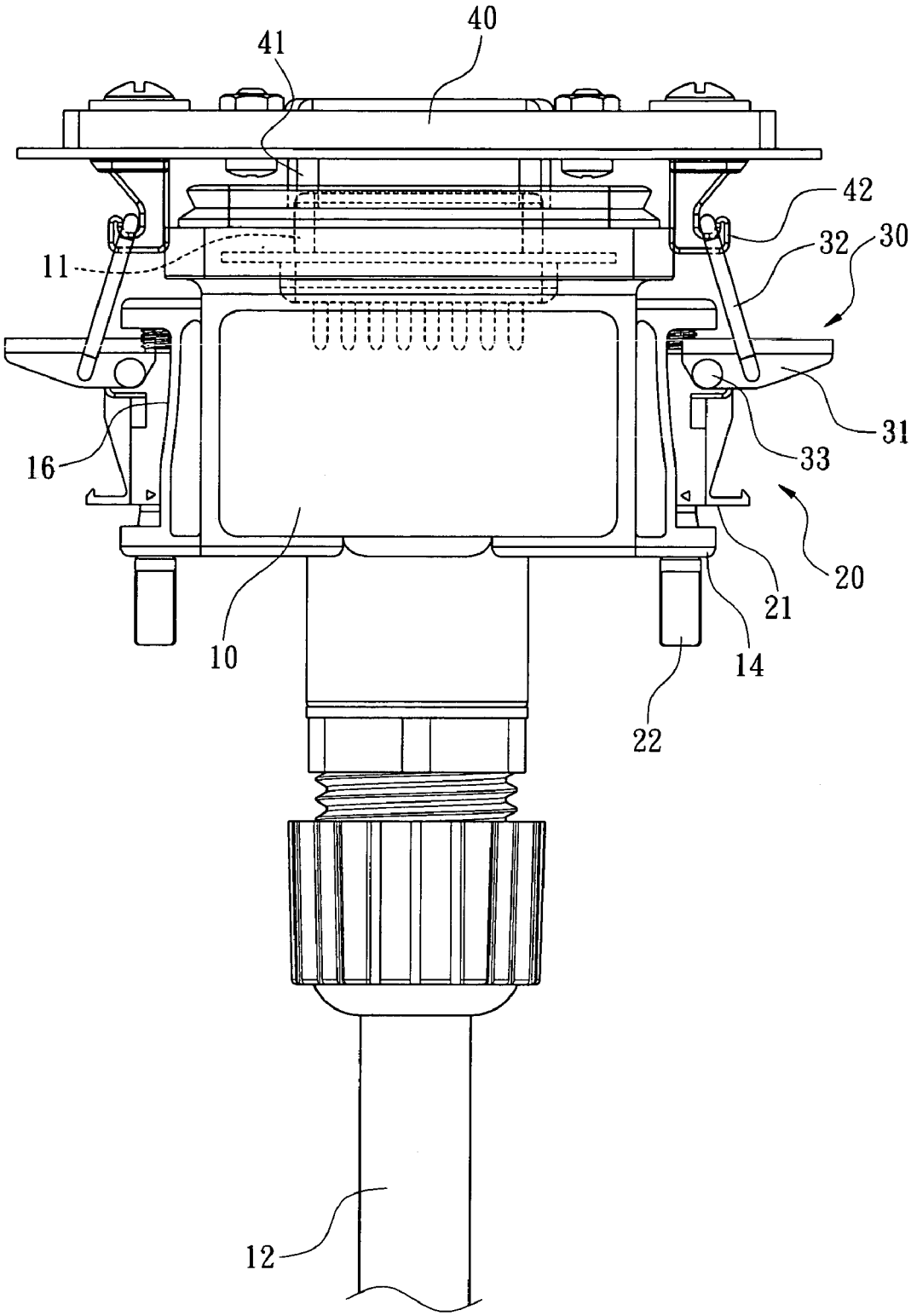
FIG. 4 illustrates the usage of the locking device in accordance with the first embodiment of the present invention.
Figure 5:
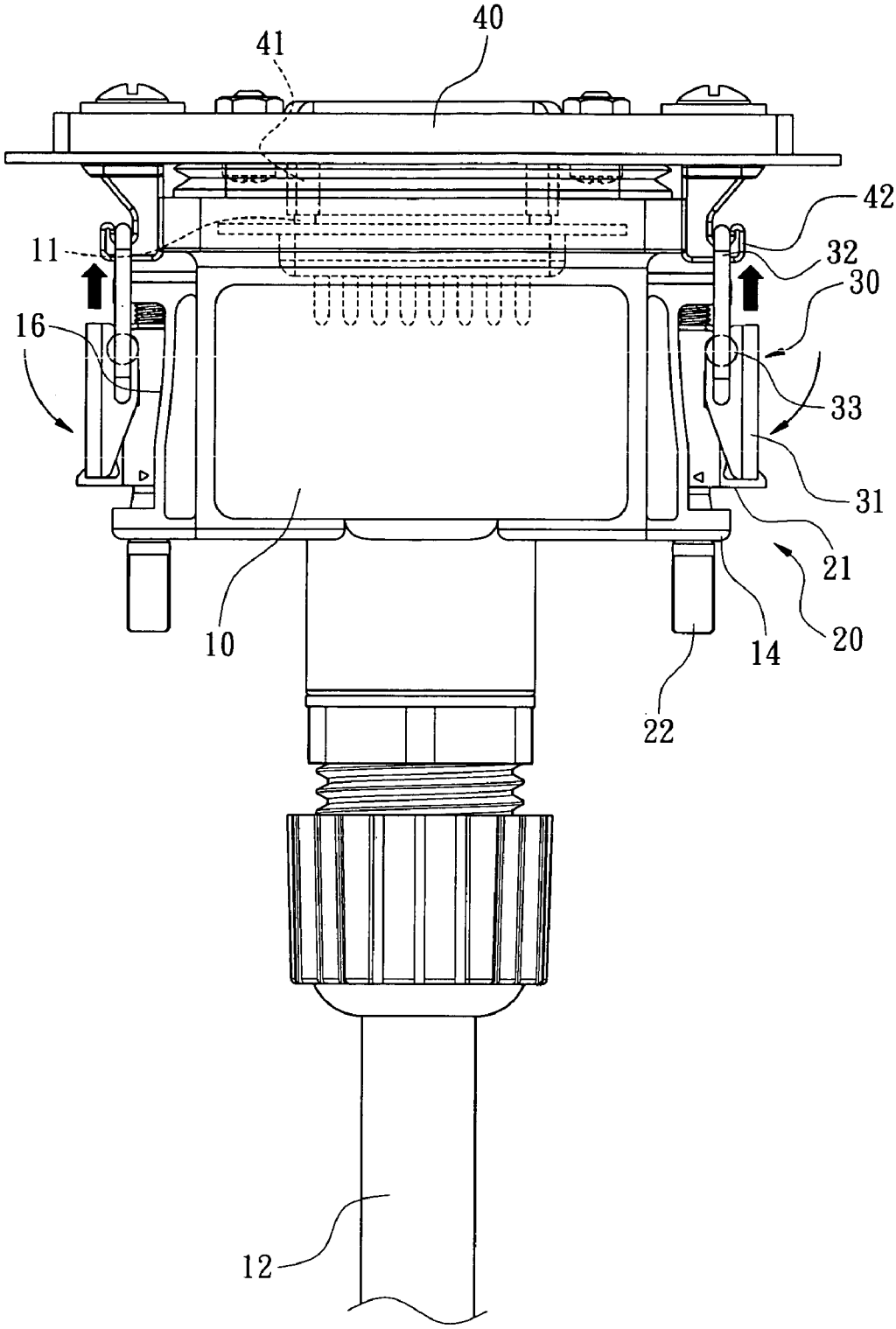
FIG. 5 illustrates the usage of the locking device in accordance with the first embodiment of the present invention.
Figure 6:
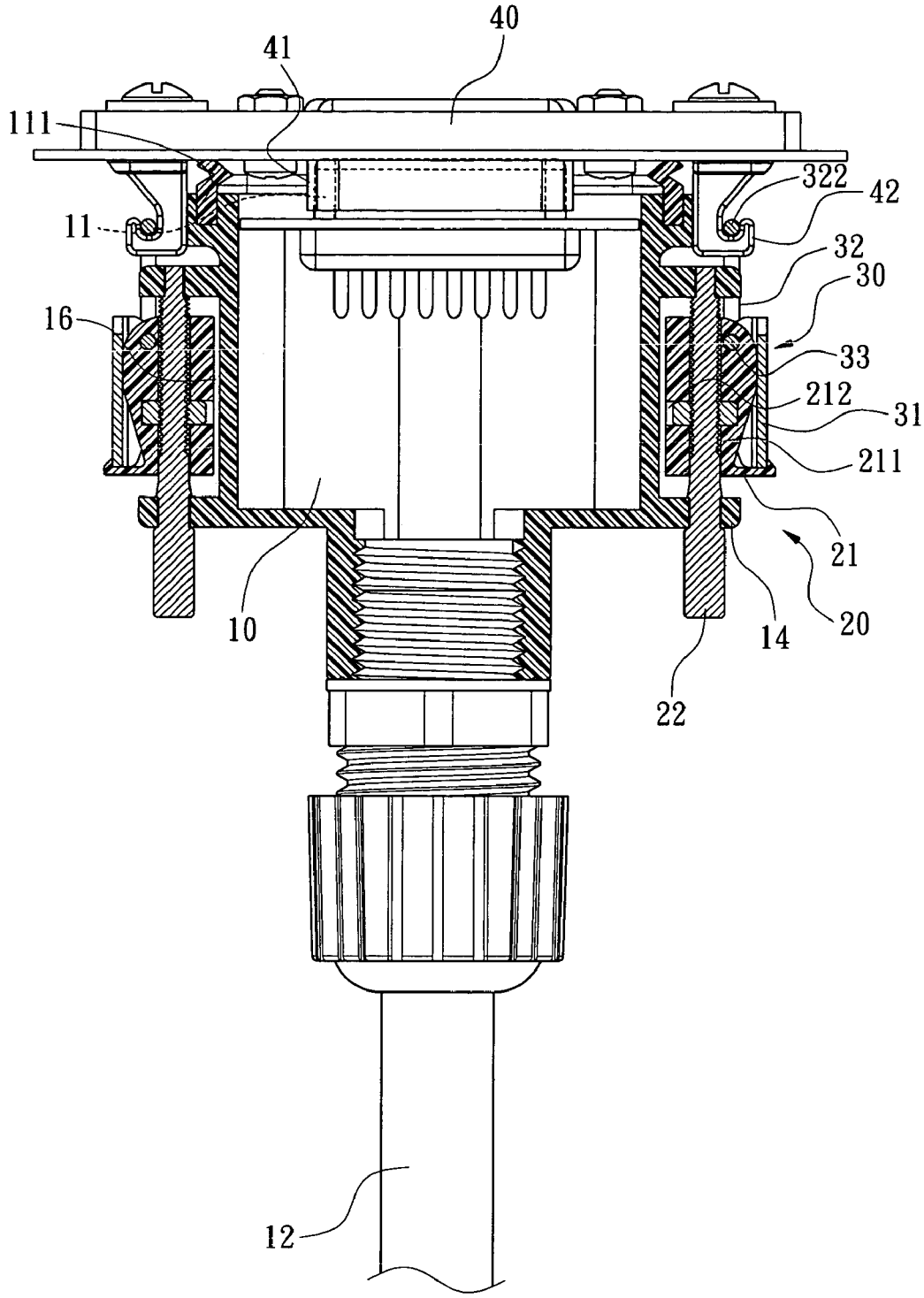
FIG. 6 is a sectional view of FIG. 5.

Referring to FIG. 4 and FIG. 5, the usage of the locking device in accordance with the first embodiment of the present invention are illustrated. Referring also to FIG. 6, the sectional view of FIG. 5 is illustrated. The combination of those elements set forth above provides the main body 10 to plug into a connection port 40. The connection port 40 includes a socket 41 at the central portion thereof for inserting therein the main body 10. A buckling hook 42 is formed at each of the left and right sides of the socket 41. The buckling hooks 42 connect the closed end 322 of the locking element 32. When using the locking device, the connection port 11 of the connector 10 is first disposed into the socket 41 of the connection port 40. Then, turning the actuating element 31 at two sides of the actuating device for the buckling element 32 to move forward. The closed end 322 of the buckling element 32 is then buckled on the corresponding buckling hook 42 of the connection port 40. By turning the actuating element 31 backward about the shaft 33 and pressing the locking hook 214 of the link element 21 at the outer periphery end of the actuating element 31, the connector main body 10 and the connection port 40 can then securely fastened and combined.

Figure 7:
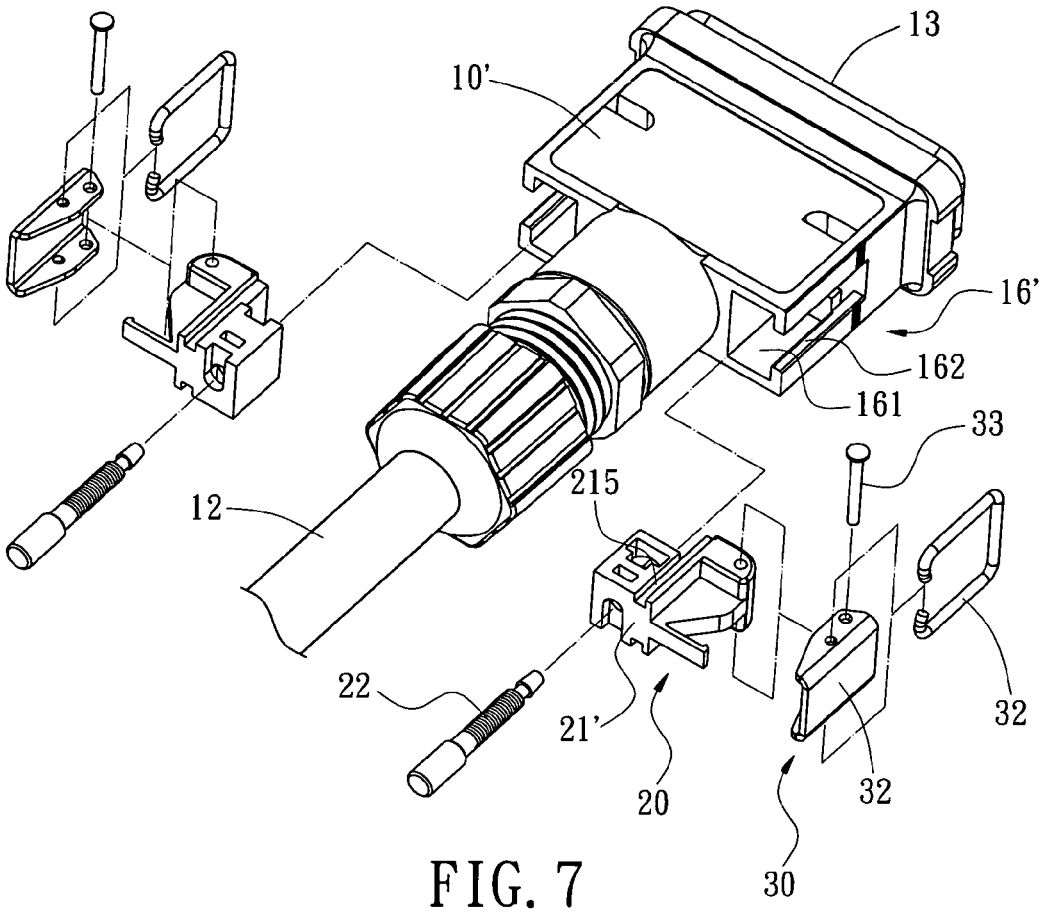
FIG. 7 is an explosive view of a locking device in accordance with the second embodiment of the present invention.
Figure 8:
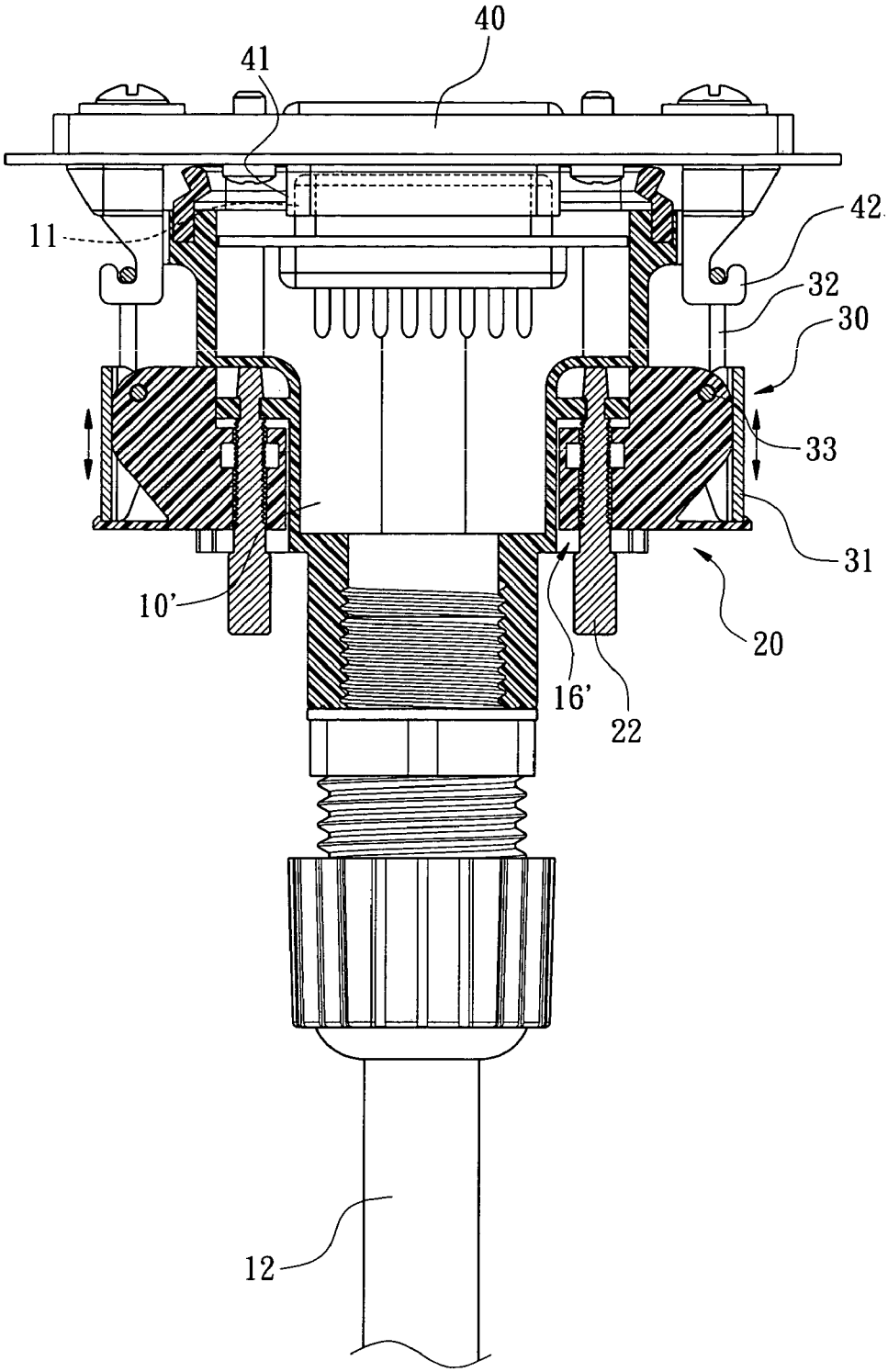
FIG. 8 is a sectional view of the locking device in accordance with the second embodiment of the present invention.

Referring to FIG. 7 and FIG. 8, a perspective view and a sectional view of the locking device in accordance with the second embodiment of the present invention is illustrated. The connection portion 16' of the connector main body 10' is composed of a rectangular guiding hole 161 and two guiding tracks 162 outside of the guiding hole 161. Two guiding grooves 215 are formed on the link element 21'. The guiding grooves 215 cooperate with the guiding track 162 of the connection portion 16' so as to dispose one end of the link element 21' into the guiding hole 161 of the connection portion 16'.

Figure 9:
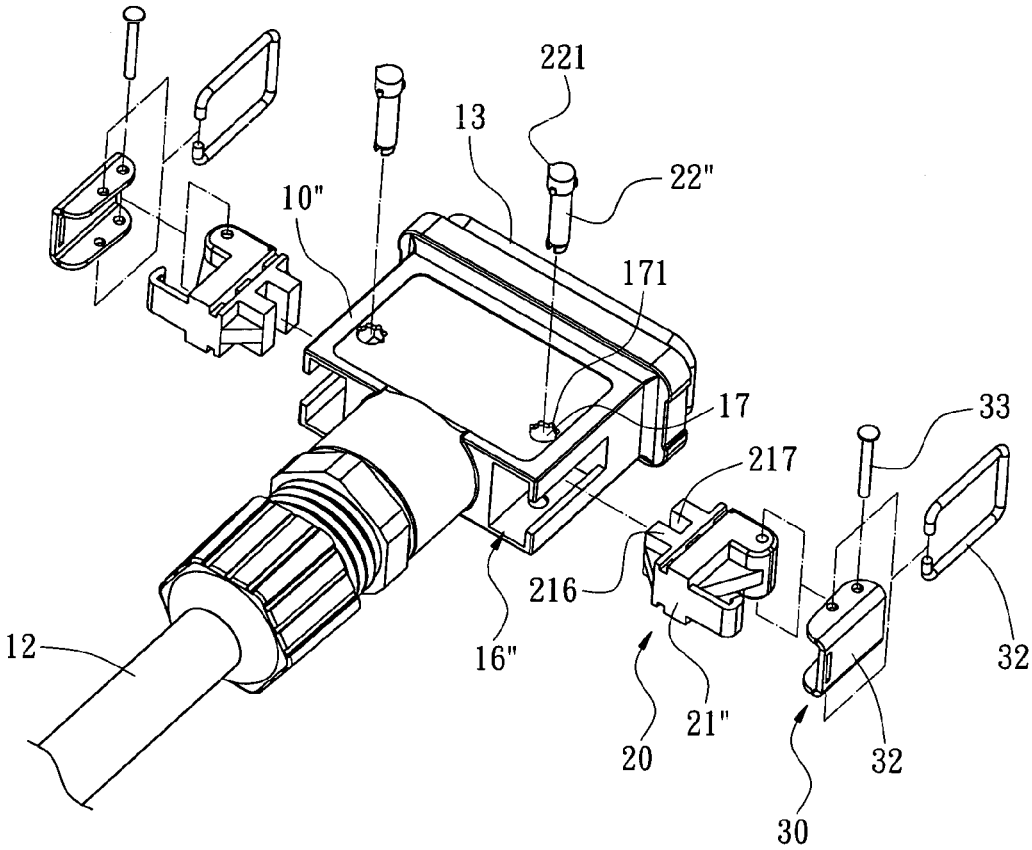
FIG. 9 is an explosive view of a locking device in accordance with the third embodiment of the present invention.
Figure 10:
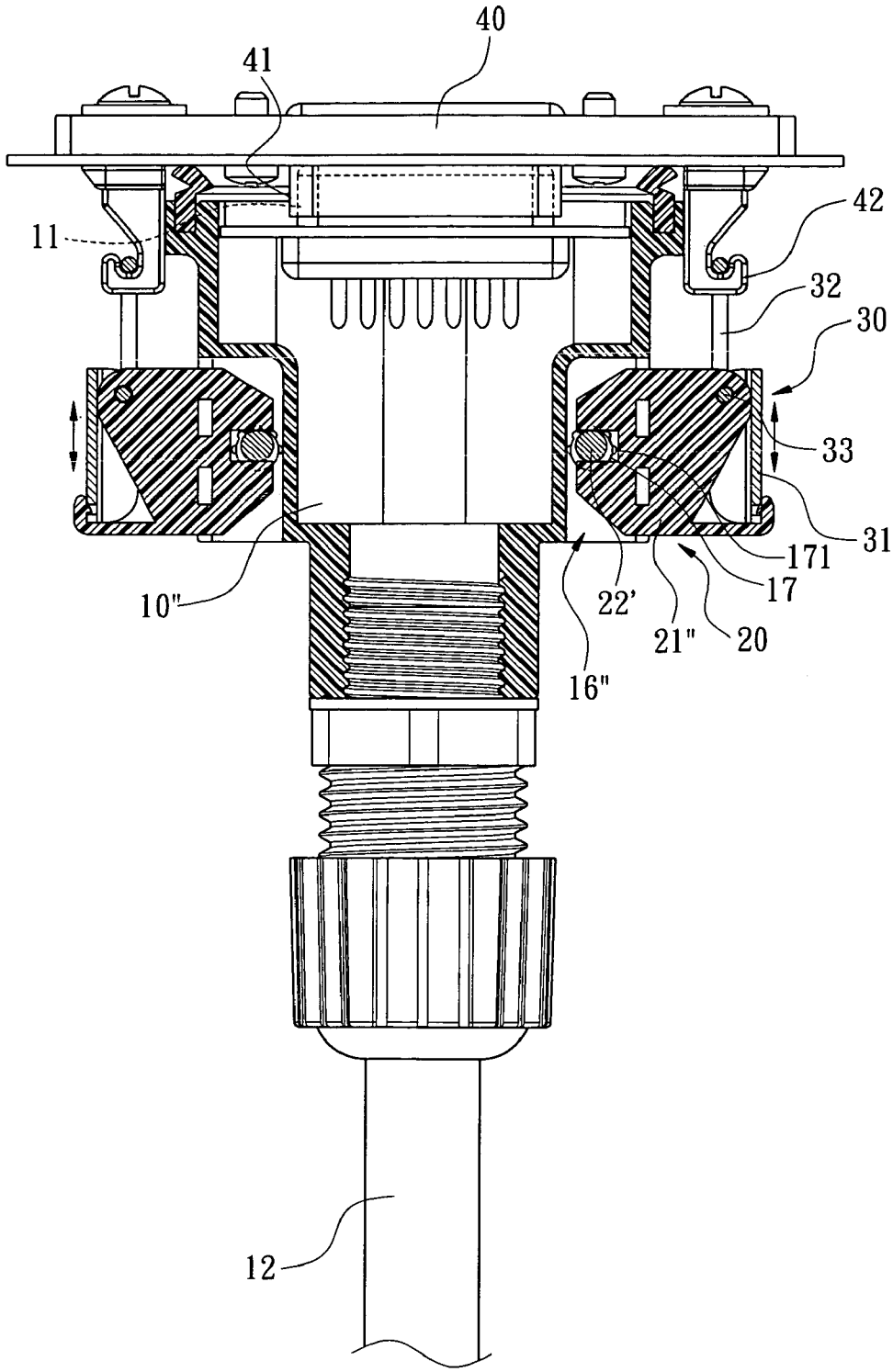
FIG. 10 is a sectional view of the locking device in accordance with the third embodiment of the present invention.

Referring to FIG. 9 and FIG. 10, a perspective view and a sectional view of the locking device in accordance with the third embodiment of the present invention are illustrated. The connection portion 16" of the connector main body 10" is composed of a rectangular guiding hole 161, two guiding tracks 162 outside of the guiding hole 161, and a vertical hole 17 communicable with the guiding hole 161. A plurality of zigzag grooves 171 is formed at the top periphery of the vertical hole 17. Two protrusive bulks 216 are formed at one side of the link element 21". A concave groove 217 is formed between the two protrusive bulks. The concave groove 217 is formed corresponding the vertical hole 17 of the connector main body 10", and providing an adjusting element 22" to penetrate therethrough. In this particular embodiment, the adjusting element is an eccentric shaft. A protrusive point 221 is formed at the top end of the adjusting element 22". The protrusive point 221 can be disposed in the zigzag groove 171 of the vertical hole 17. By rotating the adjusting element 22", one can control the link element 21" to move forward and backward.

In summary, the locking device of the present invention indeed satisfies the utility, novelty and non-obviousness requirement of the patent law, a grant of letters patent is thus respectfully requested.

However, since any person having ordinary skill in the art may readily find various equivalent alterations or modifications in light of the features as disclosed above, it is appreciated that the scope of the present invention is defined in the following claims. Therefore, all such equivalent alterations or modifications without departing from the subject matter as set forth in the following claims is considered within the spirit and scope of the present invention.

What is claimed is:

1. An adjustable locking device for a main body, comprising:

a connection portion formed on the main body;

at least a link structure, one end thereof connecting the connection portion of the main body, the link structure including a link element and an adjusting element connected to the link element; and at least a buckling device pivotally connected to the link element of the link structure, the buckling device including an actuating element and a buckling element, the actuating element connecting the buckling element.

2. The adjustable locking device as recited in claim 1, wherein the main body is an electrical connector, which comprises a connection port.

3. The adjustable locking device as recited in claim 2, wherein the connection portion includes two protrusive ears and a sag region between the two protrusive ears, a through hole being disposed on the protrusive ears, a penetrating hole being formed on the link element of the link structure, whereby the penetrating hole and the through hole provides the adjusting element to penetrate therethrough, so as to fasten the link element into the sag region of the connection portion.

4. The adjustable locking device as recited in claim 2, wherein the connection portion includes a guiding hole and a guiding track, while the link element includes a guiding groove, the guiding groove cooperating with the guiding track of the connection portion, thereby disposing one end of the link element into the guiding hole of the connection portion.

5. The adjustable locking device as recited in claim 4, wherein the main body further comprises a vertical hole communicable with the guiding hole, a plurality of zigzag grooves being formed on the top periphery of the vertical hole, two protrusive bulks being formed extending from one side of the link element, thereby forming a concave groove therebetween, the concave groove being formed corresponding the vertical hole of the main body for penetrating therethrough an adjusting element.

6. The adjustable locking device as recited in claim 5, wherein a protrusive point is formed at the top end of the adjusting element, the protrusive point being formed corresponding the zigzag groove of the vertical hole, whereby the link element is moved forward and backward by rotating the adjusting element.

7. The adjustable locking device as recited in claim 2, wherein a locking hook is formed extending from one end of the link element of the link structure, wherein the locking hook is formed that corresponds the end of the actuating element of the locking device and is pressed.

8. The adjustable locking device as recited in claim 2, wherein a hole is formed on the link element of the link structure, while a first through hole and a second through hole is formed on the actuating element of the buckling device, the first through hole and the hole providing a shaft to penetrate therethrough, thereby combining the link element and the actuating device.

9. The adjustable locking device as recited in claim 8, wherein the buckling element of the buckling device is composed of curved metallic wire, which comprises an opening end, and two cylindrical shafts being formed on the opening end for penetrating through the second through hole of the actuating element.

10. The adjustable locking device as recited in claim 9, wherein the buckling element of the buckling device is made of a frame of one of a rectangular shape, a semi-circular shape, a triangular shape and a trapezoidal shape.

* * * * *